US008111200B2

(12) United States Patent
Yagi et al.

(10) Patent No.: US 8,111,200 B2
(45) Date of Patent: Feb. 7, 2012

(54) PLANAR ANTENNA AND ELECTRONIC DEVICE

(75) Inventors: Shigeru Yagi, Tokyo (JP); Yuki Kotaka, Tachikawa (JP); Fuminori Sano, Hamura (JP)

(73) Assignee: Casio Computer Co., Ltd., Tokyo (JP)

( * ) Notice: Subject to any disclaimer, the term of this patent is extended or adjusted under 35 U.S.C. 154(b) by 249 days.

(21) Appl. No.: 12/473,680

(22) Filed: May 28, 2009

(65) Prior Publication Data

US 2009/0295652 A1 Dec. 3, 2009

(30) Foreign Application Priority Data

May 29, 2008 (JP) ..... 2008-140595

(51) Int. Cl.
*H01Q 1/24* (2006.01)

(52) U.S. Cl. ..... 343/702

(58) Field of Classification Search ..... 343/702, 343/700 MS

See application file for complete search history.

(56) References Cited

U.S. PATENT DOCUMENTS

| | | | |
|---|---|---|---|
| 5,926,150 | A | 7/1999 | McLean et al. |
| 6,421,014 | B1 | 7/2002 | Sanad |
| 6,529,170 | B1 | 3/2003 | Nishizawa et al. |
| 6,600,448 | B2 | 7/2003 | Ikegaya et al. |
| 6,621,464 | B1 | 9/2003 | Fang et al. |
| 6,847,328 | B1 | 1/2005 | Libonati et al. |
| 6,853,336 | B2 | 2/2005 | Asano et al. |
| 6,870,504 | B2 | 3/2005 | Ikegaya et al. |
| 6,906,677 | B2 * | 6/2005 | Yamamoto et al. ..... 343/789 |
| 6,917,333 | B2 | 7/2005 | Ikegaya et al. |
| 7,176,843 | B2 | 2/2007 | Shimasaki et al. |
| 7,248,224 | B2 | 7/2007 | Yuanzhu |
| 7,265,720 | B1 | 9/2007 | Ponce De Leon et al. |
| 7,372,406 | B2 | 5/2008 | Shiotsu et al. |
| 7,375,686 | B2 | 5/2008 | Ku et al. |
| 7,389,129 | B2 | 6/2008 | Shoji |
| 7,423,598 | B2 | 9/2008 | Bit-Babik et al. |

(Continued)

FOREIGN PATENT DOCUMENTS

DE 101 47 921 A1 4/2003

(Continued)

OTHER PUBLICATIONS

Extended European Search Report dated Aug. 14, 2009 (8 pages), issued in counterpart European Application No. 09160450.4.

(Continued)

*Primary Examiner* — Huedung Mancuso

(74) *Attorney, Agent, or Firm* — Holtz, Holtz, Goodman & Chick, PC

(57) ABSTRACT

Disclosed is a planar antenna, including: a film formed of a planar insulating material; an antenna portion which is a planar conductor on the film; and a ground portion which is a conductor to be grounded, wherein the antenna portion comprises: at least one first short stub; a first antenna element which is connected to the ground portion through the at least one first short stub and whose shape has such an angle that a distance between the first antenna element and the ground portion increases with increasing distance from a feeding point along the ground portion, the feeding point being provided between the first antenna element and the ground portion; a second short stub; and a second antenna element which is connected to the first antenna element through the second short stub.

12 Claims, 15 Drawing Sheets

U.S. PATENT DOCUMENTS

| | | | | |
|---|---|---|---|---|
| 7,612,720 | B2 | 11/2009 | Kerselaers | |
| 7,777,682 | B2 | 8/2010 | Yagi | |
| 7,864,115 | B2 * | 1/2011 | Yamazaki et al. | 343/700 MS |
| 7,889,139 | B2 * | 2/2011 | Hobson et al. | 343/702 |
| 2003/0045324 | A1 | 3/2003 | Nagumo et al. | |
| 2004/0137971 | A1 | 7/2004 | Shoji | |
| 2004/0201528 | A1 | 10/2004 | Lee et al. | |
| 2004/0217916 | A1 | 11/2004 | Quintero Illera et al. | |
| 2004/0222936 | A1 | 11/2004 | Hung et al. | |
| 2004/0246188 | A1 | 12/2004 | Egashira | |
| 2005/0035919 | A1 | 2/2005 | Yang et al. | |
| 2005/0200556 | A1 | 9/2005 | Lin et al. | |
| 2005/0212706 | A1 | 9/2005 | Ying et al. | |
| 2005/0280579 | A1 | 12/2005 | Liang et al. | |
| 2006/0001590 | A1 | 1/2006 | Hung et al. | |
| 2006/0017643 | A1 | 1/2006 | Shimasaki et al. | |
| 2006/0022888 | A1 | 2/2006 | Cheng | |
| 2006/0132362 | A1 | 6/2006 | Yuanzhu | |
| 2006/0170605 | A1 | 8/2006 | Tang et al. | |
| 2006/0187135 | A1 | 8/2006 | Maniwa et al. | |
| 2006/0208950 | A1 | 9/2006 | Tago | |
| 2007/0040751 | A1 | 2/2007 | Boyle | |
| 2007/0052610 | A1 | 3/2007 | Lee | |
| 2007/0103367 | A1 | 5/2007 | Wang | |
| 2007/0268190 | A1 | 11/2007 | Huynh | |
| 2008/0180339 | A1 | 7/2008 | Yagi | |
| 2008/0180342 | A1 | 7/2008 | Kerselaers | |
| 2008/0284662 | A1 | 11/2008 | Yagi | |
| 2008/0316116 | A1 * | 12/2008 | Hobson et al. | 343/702 |
| 2008/0316121 | A1 * | 12/2008 | Hobson et al. | 343/702 |
| 2009/0167619 | A1 | 7/2009 | Yagi | |
| 2010/0302111 | A1 | 12/2010 | Kotaka et al. | |

FOREIGN PATENT DOCUMENTS

| | | | |
|---|---|---|---|
| DE | 20 2006 019 045 | U1 | 3/2007 |
| EP | 1 345 282 | A1 | 9/2003 |
| EP | 1 617 514 | A1 | 1/2006 |
| JP | 63-254803 | A | 10/1988 |
| JP | 10-093332 | A | 4/1998 |
| JP | 2001-185938 | A | 7/2001 |
| JP | 2002-055733 | A | 2/2002 |
| JP | 2003-078333 | A | 3/2003 |
| JP | 2004-072605 | A | 3/2004 |
| JP | 2004-159029 | A | 6/2004 |
| JP | 2004-356823 | A | 12/2004 |
| JP | 3622959 | B2 | 2/2005 |
| JP | 2005-130249 | A | 5/2005 |
| JP | 3656610 | B2 | 6/2005 |
| JP | 2005-284516 | A | 10/2005 |
| JP | 2005-286915 | A | 10/2005 |
| JP | 2006-067234 | A | 3/2006 |
| JP | 2006-180150 | A | 7/2006 |
| JP | 2006-254081 | A | 9/2006 |
| JP | 3830358 | B2 | 10/2006 |
| JP | 2006-529070 | T | 12/2006 |
| JP | 2007-013596 | A | 1/2007 |
| JP | 2007-027906 | A | 2/2007 |
| JP | 2007-043594 | A | 2/2007 |
| JP | 2007-124346 | A | 5/2007 |
| JP | 2008-502205 | T | 1/2008 |
| WO | WO 01/15270 | A1 | 3/2001 |
| WO | WO 2004/097980 | A1 | 11/2004 |
| WO | WO 2006/114724 | A1 | 11/2006 |

OTHER PUBLICATIONS

Japanese Office Action dated Jun. 29, 2010 and English translation thereof, issued in counterpart Japanese Application 2008-140595.

U.S. Appl. No. 12/776,583; First Named Inventor: Yuki Kotaka; Title: "Multiband Planar Antenna and Electronic Equipment"; filed May 10, 2010.

Japanese Office Action dated Mar. 29, 2011 (and English translation thereof) issued in a Japanese counterpart (Application No. 2009-127122) of related U.S. Appl. No. 12/776,583.

* cited by examiner

FIG. 2C
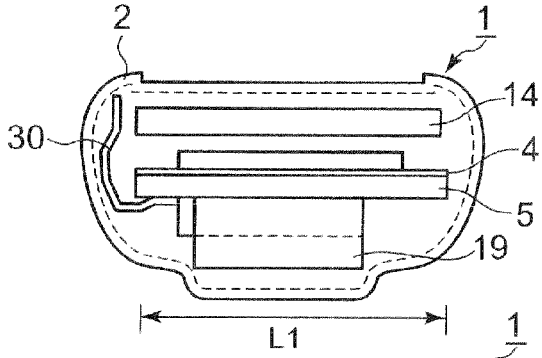
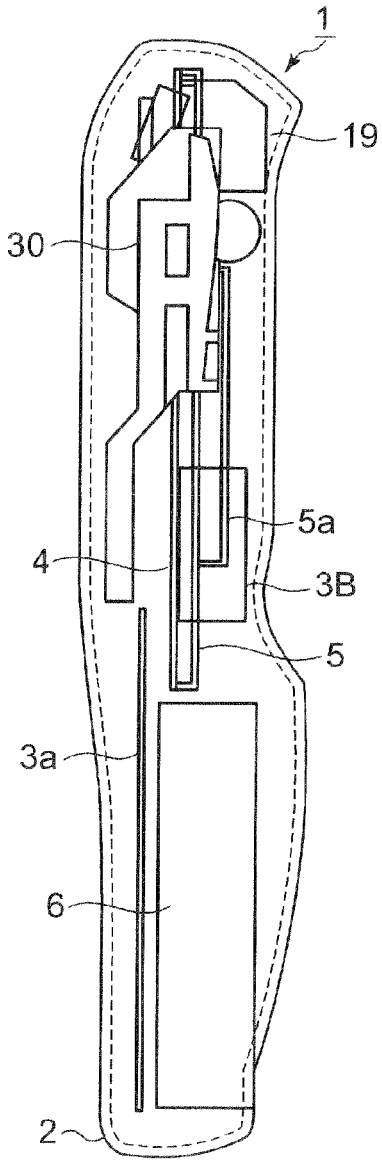
FIG. 2B
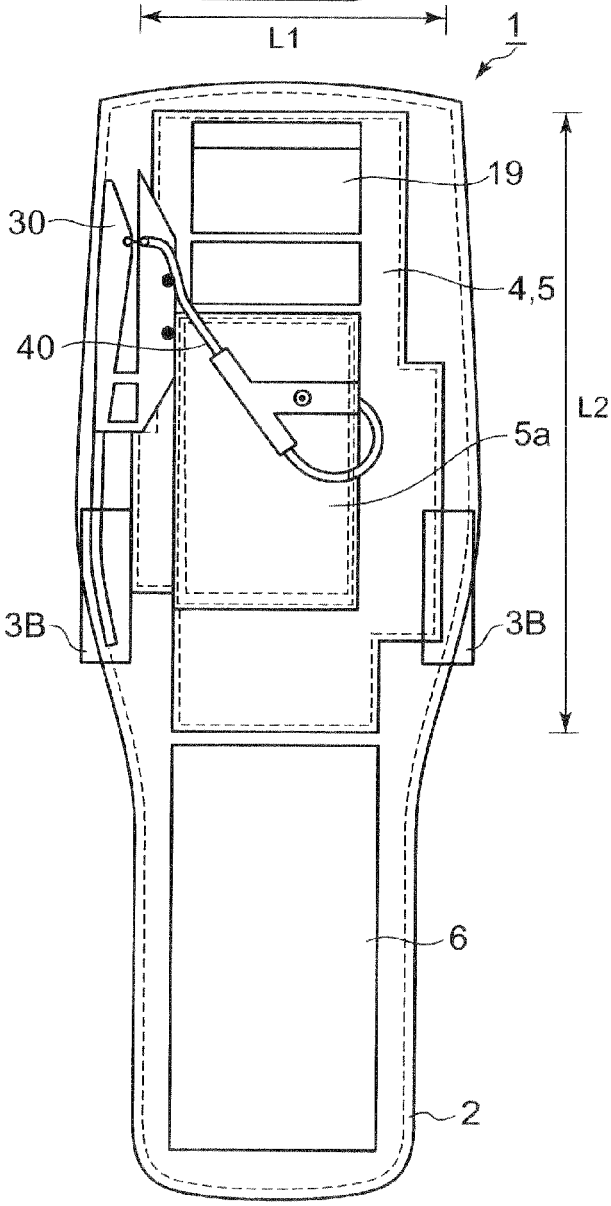
FIG. 2A

PLANAR ANTENNA AND ELECTRONIC DEVICE

BACKGROUND OF THE INVENTION

1. Field of the Invention

The present invention relates to a planar antenna and an electronic device.

2. Description of Related Art

Portable devices such as a handy terminal having a wireless communication function, PDA (Personal Digital Assistant), etc. have been known. A planar multiband antenna has been proposed as an antenna for wireless communication which is provided in a portable device (see JP-A-2007-13596, for example). Since the multiband antenna has a planar shape, it can easily be stored in the portable device. Moreover, wireless communications in a plurality of resonance frequency bands can be performed.

An inversed F-shaped antenna having an inversed F-shaped antenna element has also been known as an antenna for wireless communication. Furthermore, a multiband inversed F-shaped antenna has also been proposed (see JP-A-10-93332, for example).

However, the conventional multiband inversed F-shaped antenna has a plurality of rectangular antenna elements, and the band width of each resonance frequency is structurally narrow.

Since the conventional multiband inversed F-shaped antenna has a cubic resonance structure, a storage space for the antenna has to be large.

SUMMARY OF THE INVENTION

It is, therefore, a main object of the present invention to extend the band width of a resonance frequency band in a multiband antenna and also reduce a storage space for the antenna.

According to a first aspect of the present invention, there is provided a planar antenna, including: a film formed of a planar insulating material; an antenna portion which is a planar conductor on the film; and a ground portion which is a conductor to be grounded, wherein the antenna portion includes: at least one first short stub; a first antenna element which is connected to the ground portion through the at least one first short stub and whose shape has such an angle that a distance between the first antenna element and the ground portion increases with increasing distance from a feeding point along the ground portion, the feeding point being provided between the first antenna element and the ground portion; a second short stub; and a second antenna element which is connected to the first antenna element through the second short stub.

According to a second aspect of the present invention, there is provided a planar antenna, including: a film formed of a planar insulating material; an antenna portion which is a planar conductor on the film; and a ground portion which is a conductor to be grounded, wherein the antenna portion includes: at least one first short stub; a first antenna element which is connected to the ground portion through the at least one first short stub, a feeding point being provided between the first antenna element and the ground portion; a plurality of second short stubs; and a second antenna element which is connected to the first antenna element through the second short stubs.

According to the present invention, the band width of each of the plurality of resonance frequency bands can be extended in the multiband antenna, and a storage space for the antenna can be reduced.

Furthermore, according to the present invention, the band width of the resonance frequency band corresponding to a second antenna element can be extended in the multiband antenna, and also a storage space for the antenna can be reduced.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 2A is a perspective view of a back side of the handy terminal;

FIG. 2B is a perspective view of one side of the handy terminal;

FIG. 2C is a perspective view of a top side of the handy terminal;

DETAILED DESCRIPTION OF THE PREFERRED EMBODIMENT

Figure 1:
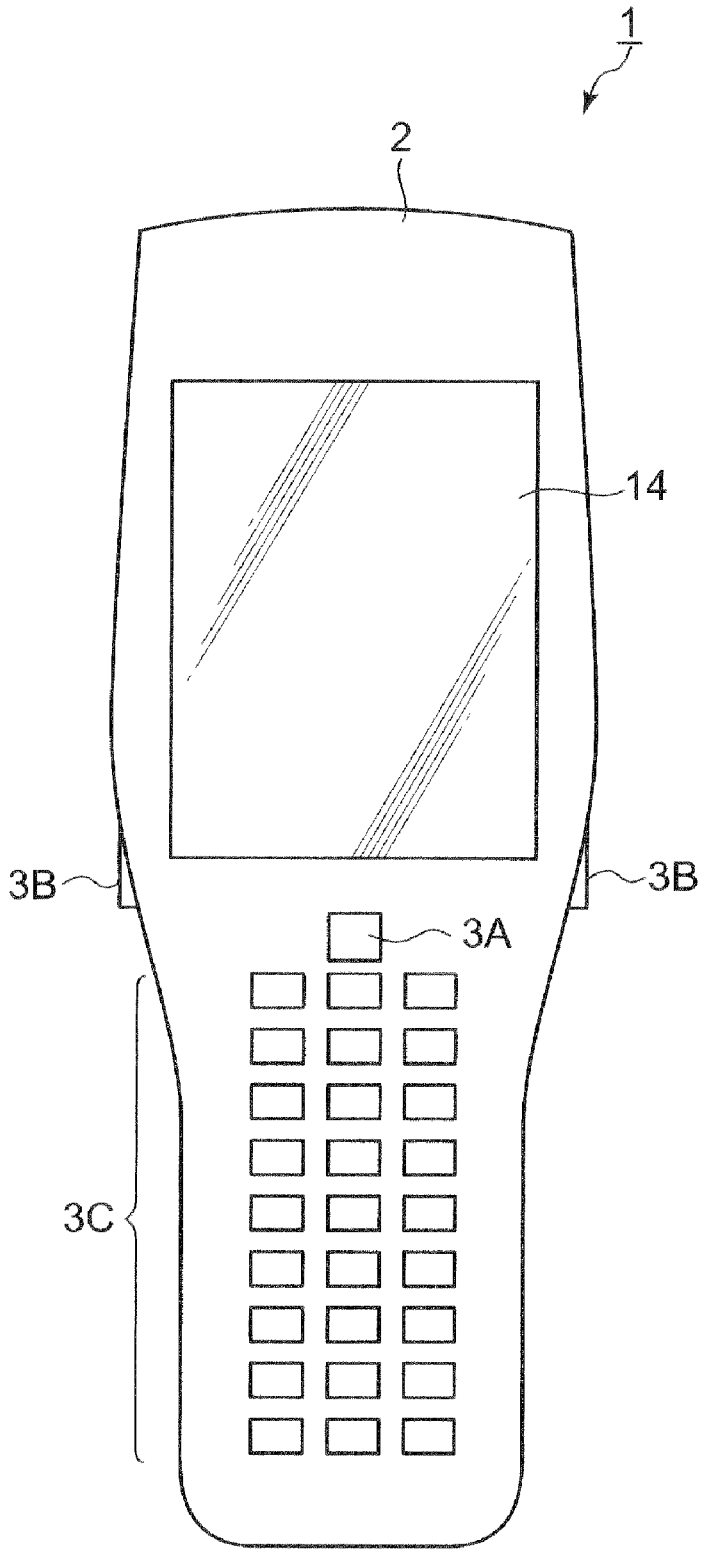
FIG. 1 is a front view showing a handy terminal according to preferred embodiments of the present invention.

Reference will now be made in detail to preferred embodiments of the present invention and first to third modifications as illustrated in the accompanying drawings. The present invention is not to be considered limited to what is shown in the drawings and the following detailed description.

The embodiments of the present invention will be described with reference to FIGS. 1 to 10. First, a device configuration of the embodiments will be explained with reference to FIGS. 1 to 5.

FIG. 1 is a front view showing a front-side configuration of a handy terminal 1 according to an embodiment. FIG. 2A is a perspective view showing a perspective configuration of the back side of the handy terminal 1, FIG. 2B is a perspective view showing a perspective configuration of one side of the handy terminal 1, and FIG. 2C is a perspective view showing a perspective configuration of the top side of the handy terminal 1.

The handy terminal 1 as an electronic device according to the embodiment is a portable terminal having functions such as input of information through a user's operation, storage of information, bar-code scanning, etc. The handy terminal 1 has ha as a function of performing wireless communication with an external device through an access point according to the wireless LAN (Local Area Network) system, and a cellular phone communication function based on the GSM (Global System for Mobile Communications) system.

The electronic device of this embodiment is not limited to the handy terminal 1, and it may contain electronic devices such as PDA (Personal Digital Assistance), a cellular phone, a portable communication terminal, a portable device having a wireless communication function such as a portable computer, etc.

As shown in FIG. 1, the handy terminal 1 has a display unit 14, a trigger key 3A, various kinds of keys 3C, etc. on the front surface of a case 2. The handy terminal 1 has trigger keys 3B on both the side surfaces of the case 2. The trigger keys 3A, 3B serve to accept light irradiation of a scanning unit 10 described later and a trigger operation input of bar-code scanning. The various kinds of keys 3C are character input keys of numerals, etc., and function keys for accepting the input of various kinds of functions such as mode switching, etc.

As shown in FIGS. 2A, 2B and 2C, the handy terminal 1 has a planar antenna 30, a coaxial cable 40 as a feeding cable, a main board 4, a chassis portion 5 as a second conductor portion, a GSM module 5*a*, a battery 6, a key board 3*a*, a scanning unit 19, etc.

The respective parts of the handy terminal 1 are connected to the main board 4. The planar antenna 30 is an antenna used for the cellular phone communication as described above. Furthermore, the planar antenna 30 is fixed to the chassis portion 5 through screws. The planar antenna 30 will be described in detail later.

The chassis portion 5 is a chassis portion of the GSM module 5*a*, etc. The chassis portion 5 is formed of metal (conductor) of magnesium alloy, aluminum or the like, and electrically grounded. Therefore, the chassis portion functions as a ground portion of the planar antenna 30. The chassis portion 5 is regarded as being substantially rectangular, and the length in the short-side direction (lateral direction) and the length in the long-side direction (longitudinal direction) are represented by L1 and L2, respectively. The lengths L1 and L2 correspond to the resonance frequencies of radio waves transmitted and received by the planar antenna 30. The GSM module 5*a* is a module for performing the cellular-phone communication and is connected to the planar antenna 30 through a coaxial cable 40.

The scanning unit 19 is a reading module for applying light such as a laser beam or the like to a bar-code and receiving and binarizing reflection light from the bar-code to read data of the bar-code. The battery 6 supplies power for the power supply of the handy terminal 1. The key board 3*a* is provided with the trigger key 3A and the various kinds of keys 3C thereon, and outputs key input signals of these keys to the main board 4.

Figure 3:
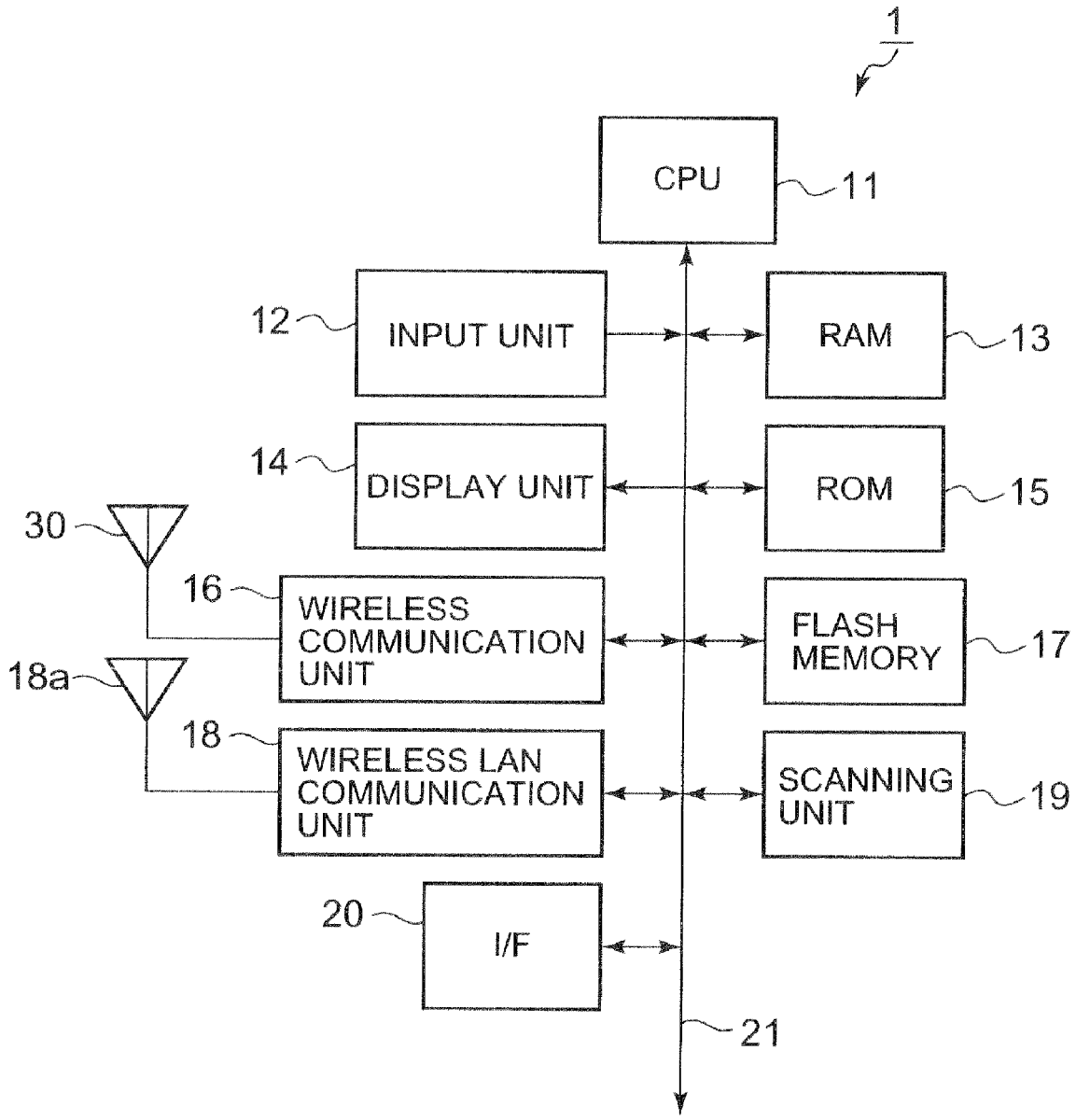
FIG. 3 is a block diagram showing a circuit configuration of the handy terminal.

FIG. 3 is a block diagram showing the circuit configuration of the handy terminal 1.

As shown in FIG. 3, the handy terminal 1 has CPU (Central Processing Unit) 11 as a controller, an input unit 12, RAM (Random Access Memory) 13, a display unit 14, ROM (Read Only Memory) 15, a wireless communication unit 16 as a communication unit having a planar antenna 30, a flash memory 17, a wireless LAN communication unit 18 having an antenna 18*a*, a scanning unit 19, I/F (Inter Face) 20, etc., and the respective parts are connected to one another through a bus 21.

The CPU 11 controls the respective units of the handy terminal 1. The CPU 11 reads out a specified program from the ROM 15 which stores a system program and various application programs, loads the specified program into the RAM 13, and carries out various processing in cooperation with the program loaded into the RAM 13.

In cooperation with the various programs, the CPU 11 accepts an input of operating information through the input unit 12, reads out various information from the ROM 15, reads out and writes various information from and into the flash memory 17. Moreover, the CPU 11 controls the wireless communication unit 16 so that the handy terminal 1 can communicate with an external device through a base station using the planar antenna 30. The CPU 11 controls the wireless LAN communication unit 18 so that the handy terminal 1 can communicate with an external device through an access point using the antenna 18*a*. The CPU 11 controls the scanning unit 19 to read data of a bar code. The CPU 11 communicates with an external device through the I/F 20 using a communication cable.

The input unit 12 includes the trigger keys 3A, 3B and various keys 3C, and outputs a key input signal of each key pressed by an operator to the CPU 11. The input unit 12 may be designed to integrate with the display unit 14 so that a touch panel can be formed.

The RAM 13 is a volatile memory for temporarily storing information. The RAM 13 has a working area for temporarily storing various programs executed by the CPU 11 and various data associated with these programs.

The display unit 14 has a display such as liquid crystal display (LCD) and electro luminescent display (ELD). The display unit 14 executes a display processing in accordance with a signal from the CPU 11.

The ROM 15 is a read only storage unit in which various programs and data are stored.

The wireless communication unit 16 is connected to the planar antenna 30, and transmits/receives information to/from a base station through the GMS type communication by using the planar antenna 30. In this embodiment, multi-band wireless communication whose resonance frequency bands are set to about 800 [MHz] band (frequency f2 band) and about 1900 [MHz] band (frequency f1 band) is performed as the GSM type communication. The planar antenna 30 is also matched with these resonance frequency bands. However, the present invention is not limited to this embodiment, and the planar antenna 30 and the wireless communication unit 16 may be adapted to other resonance frequency bands or designed to perform wireless communications based on other wireless communication systems.

The flash memory 17 is a storage unit which can read out and write information such as various kinds of data.

The wireless LAN communication unit 18 is connected to the antenna 18*a*. The wireless LAN communication unit 18 sends and receives information to and from an external device using the antenna 18*a* through an access point via wireless LAN communication.

The scanning unit 19 has a light emitting unit for laser beam or the like, a light receiving unit, a gain circuit, a binarizing circuit, etc. In the scanning unit 19, light emitted from the light emitting unit is applied to a bar-code, and reflection light from the bar-code is received and converted to an electrical signal by the light receiving unit. The electrical signal is amplified in the gain circuit, and converted to data of a white and black bar-code image in the binarizing circuit. As described above, the scanning unit 19 reads a bar-code image, and outputs the data of the bar-code image concerned to CPU 11.

The I/F 20 sends and receives information to and from an external device through a communication cable. The I/F 20 is a cable communication unit using universal serial bus (USB), for example.

Next, a configuration of the planar antenna 30 will be explained with reference to FIG. 4.

Figure 4:
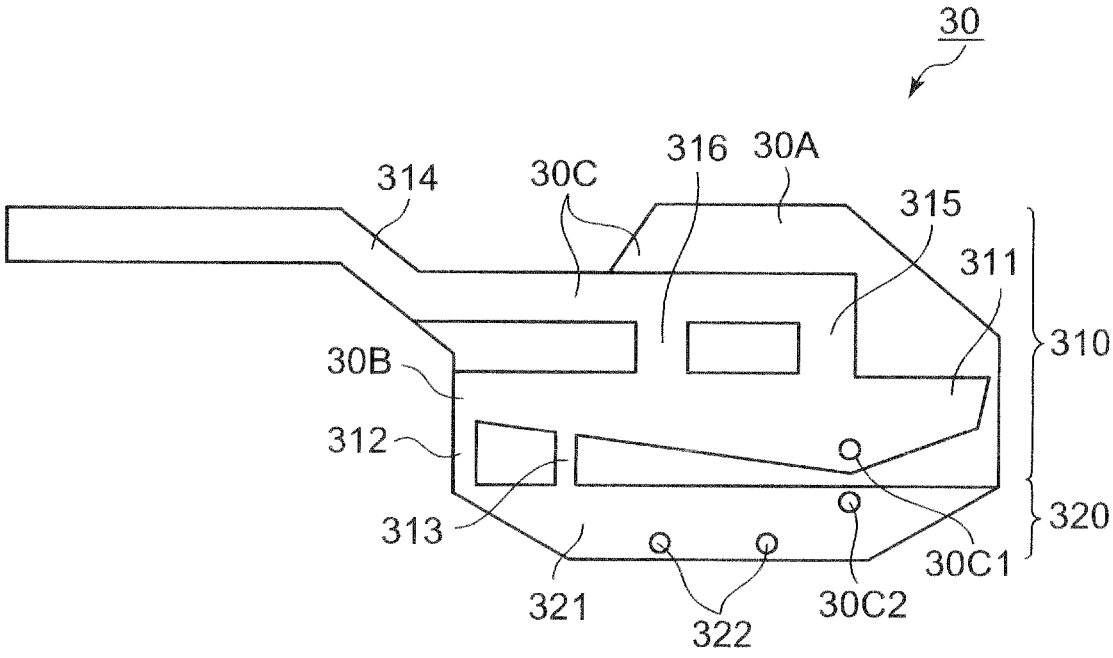
FIG. 4 shows a configuration of a planar antenna according to the embodiments.

FIG. 4 shows a configuration of the planar antenna 30.

The planar antenna 30 includes a film 30A, an antenna conductor portion 30B and an insulating layer 30C. The film 30A is a film of FPC (Flexible Print Circuit), and is formed of an insulator such as polyimide. The antenna conductor 30B is formed of a single planar conductor such as copper foil, and is print-wired on the film 30A. The insulating layer 30C is formed of an insulator as a film of FPC, for example, and is formed on the film 30A and the antenna conductor 30B. The insulating layer 30C has hole portions 30C1 and 30C2 for soldering.

The antenna conductor 30B comprises an antenna portion 310 and a ground portion 320 as a first conductor portion. Power is supplied to the antenna portion 310 and the ground portion 320 is grounded. The antenna portion 310 has an antenna element 311 as a first antenna element, short stubs 312 and 313 as first short stubs, an antenna element 314 as a second antenna element, and short stubs 315 and 316 as second short stubs. The ground portion 320 has a ground element 321 and screw holes 322.

The antenna element 311 is an antenna element for resonance at a higher resonance frequency f1 of the two resonance frequencies f1 and f2. The antenna element 311 has an almost triangular shape so that a vertex of the triangle is located in the neighborhood of the ground element 321.

The coaxial cable 40 is connected between the vertex portion of the antenna element 311 (corresponding to the position of the hole portion 30C1) and an opposed portion to the vertex portion of the ground element 321 (corresponding to the position of the hole portion 30C2) by soldering. This connection portion is referred to as a feeding point P.

The antenna element 311 is connected to the short stub 312 at one end in the longitudinal direction thereof, and also connected to the short stub 313 so as to be spaced from the connection position of the short stab 312 at a predetermined distance. Furthermore, the short stub 312 is connected to the ground element 321. The short stub 313 is connected to the ground element 321 so as to be spaced from the connection position between the short stub 312 and the ground element 321 at a predetermined distance.

The antenna element 314 is an antenna element for resonance at a lower resonance frequency f2 of the two resonance frequencies f1 and f2. The antenna element 314 is strip-shaped, and has a bending portion at some midpoint thereof. The bending portion is matched with the mount space of the planar antenna 30, and the present invention is not limited to this shape. The antenna element 314 is connected to the short stub 315 at one end in the longitudinal direction thereof, and also connected to the short stub 316 so as to be spaced from the connection point of the short stub 315 at a predetermined distance. Furthermore, the short stub 315 is connected to a predetermined position of an intermediate portion in the longitudinal direction of the antenna element 311. The longitudinal directions of the antenna element 311, the antenna element 314 and the ground element 321 are set to one another.

The ground element 321 is trapezoidal, however, the present invention is not limited to this shape. The ground element 321 is fixedly connected and electrically conducted to the chassis portion 5 by fixing screws through the screw holes 322. Therefore, the ground portion 320 and the chassis portion 5 integrally function as the ground.

Next, the connection between the planar antenna 30 and the coaxial cable 40 at the feeding point P will be described with reference to FIG. 5.

Figure 5:
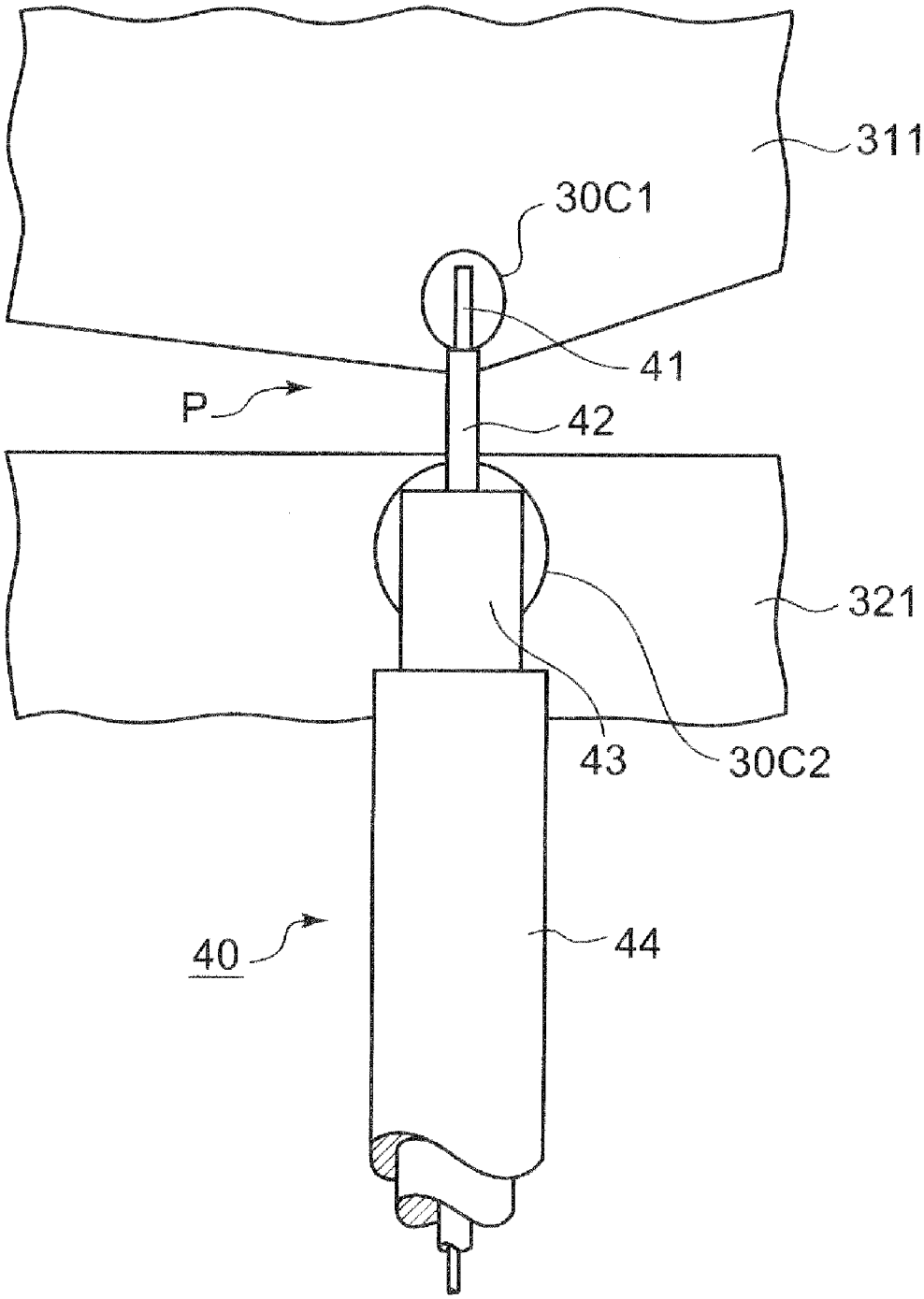
FIG. 5 shows a connection configuration between the planar antenna and a coaxial cable in the embodiments.

FIG. 5 is a diagram showing the connection configuration between the planar antenna 30 and the coaxial cable 40. The film 30A and the insulating layer 30C are omitted from the illustration of FIG. 5.

The coaxial cable 40 has a core wire 41 formed of copper wire or the like, an insulator 42 formed of polyethylene or the like, an external conductor 43 formed of a meshed copper wire or the like and a protection coating member 44 as an insulator which are successively arranged concentrically. The core wire 41 at one end of the coaxial cable 40 is passes through the hole portion 30C1 and connected to the antenna element 311 by soldering, and the external conductor 43 is passes through the hole portion 30C2 and connected to the ground element 321 by soldering.

The other end of the coaxial cable 40 is connected to the GSM module 5*a*. The core wire 41 at the other end of the coaxial cable 40 is connected to a power feeding terminal of the GSM module 5*a*, and the external conductor 43 is connected to the ground of the GSM module 5*a*. High frequency power is supplied from the GSM module 5*a* through the coaxial cable 40 to the feeding point P.

Next, the details of the planar antenna 30 will be described with reference to FIGS. 6 to 10. In order to simplify the description and the illustration, the antenna conductor portion 30B of the planar antenna 30 will be described, and the description and illustration of the film 30A and the insulating layer 30C are omitted.

First, the operation principle of a basic multiband planar antenna 50 will be described.

Figure 6:
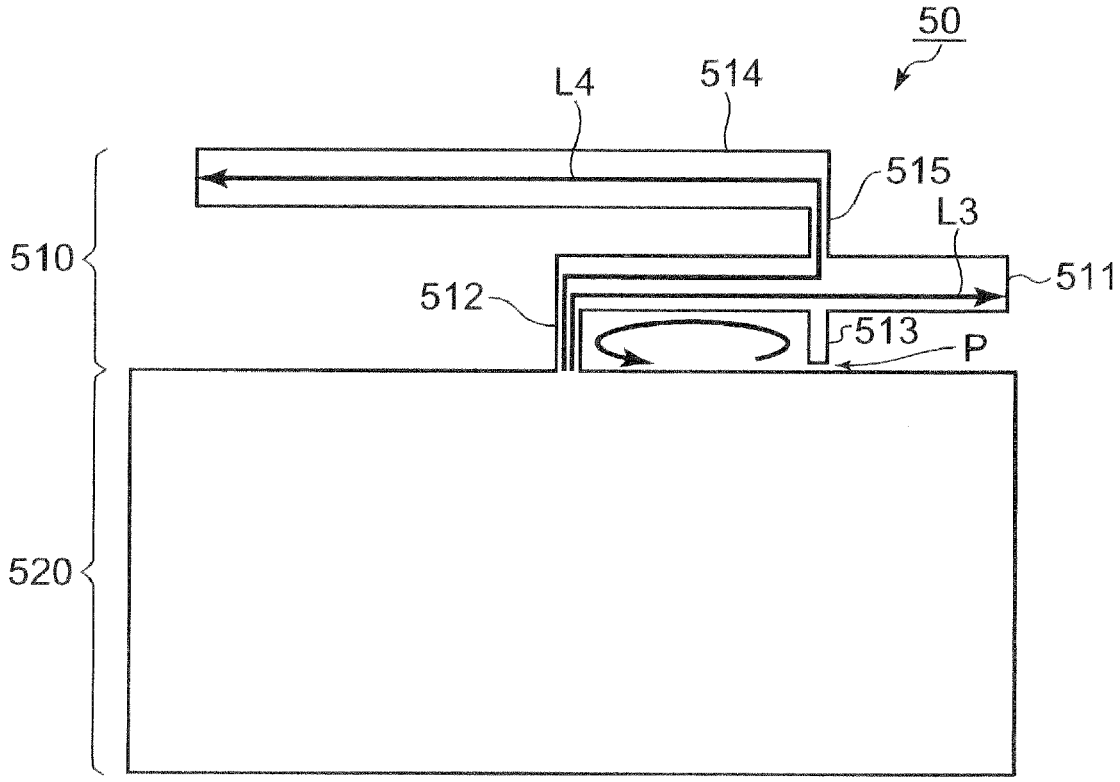
FIG. 6 shows a configuration of a basic multiband planar antenna.

FIG. 6 is a diagram showing the configuration of the basic multiband planar antenna 50. The planar antenna 50 is an antenna resonating at frequencies f1 and f2.

As shown in FIG. 6, the planar antenna 50 has an antenna portion 510 and a ground portion 520. The antenna portion 510 has a antenna element 511, short stubs 512 and 513, an antenna element 514 and a short stub 515 which are rectangular in shape.

The antenna element 511 is disposed so that the longitudinal direction thereof is parallel to the ground portion 520, and connected to the ground portion 520 through the short stubs 512 and 513. The antenna element 514 is disposed so that the longitudinal direction thereof is parallel to the longitudinal direction of the antenna element 511, and connected to the antenna element 511 through the short stub 515. A feeding point P is provided between one end of the short stub 513 and the ground portion 520.

The ground portion 520, the short stub 513, the antenna element 511 and the short stub 512 constitutes a minute loop portion, and loop current flows into the loop portion, whereby the impedance matching is established and the depth of the resonance is adjusted.

The length L3 of a route passing through the short stub 512 and the antenna element 511 as a current-flowing route is set to ¼ of the wavelength λ1 of the resonance frequency f1. Likewise, the length L4 of a route passing through the short stub 512, the antenna element 511, the short stub 515 and the antenna element 514 as a current-flowing route is set to ¼ of the wavelength λ2 of the resonance frequency f2. Therefore, the planar antenna 50 functions as a multiband antenna resonating when the radio waves of the two resonance frequency f1, f2 bands are transmitted/received, thereby obtaining a high gain.

As described above, the planar antenna 50 is the multiband antenna of the two resonance frequency f1, f2 bands. However, there is a little mode resonating in each frequency band, so that the band width thereof is relatively narrow.

Next, the planar antenna 30 according to this embodiment will be described. First, as in the case of the planar antenna 50, the planar antenna 30 resonates at the two resonance frequencies f1, f2 (f1>f2). The length of a route passing through the short stubs 312, 313 and the antenna element 311 as a current-flowing route is set to ¼ of the wavelength λ1 of the resonance frequency f1. Furthermore, the length of a route passing through the short stubs 312, 313, the antenna element 311, the short stubs 315, 316 and the antenna element 314 as a current-flowing route is set to ¼ of the wavelength λ2 of the resonance frequency f2.

Next, the configuration of broadening the resonance frequency band of the planar antenna 30 will be described.

Figure 7:
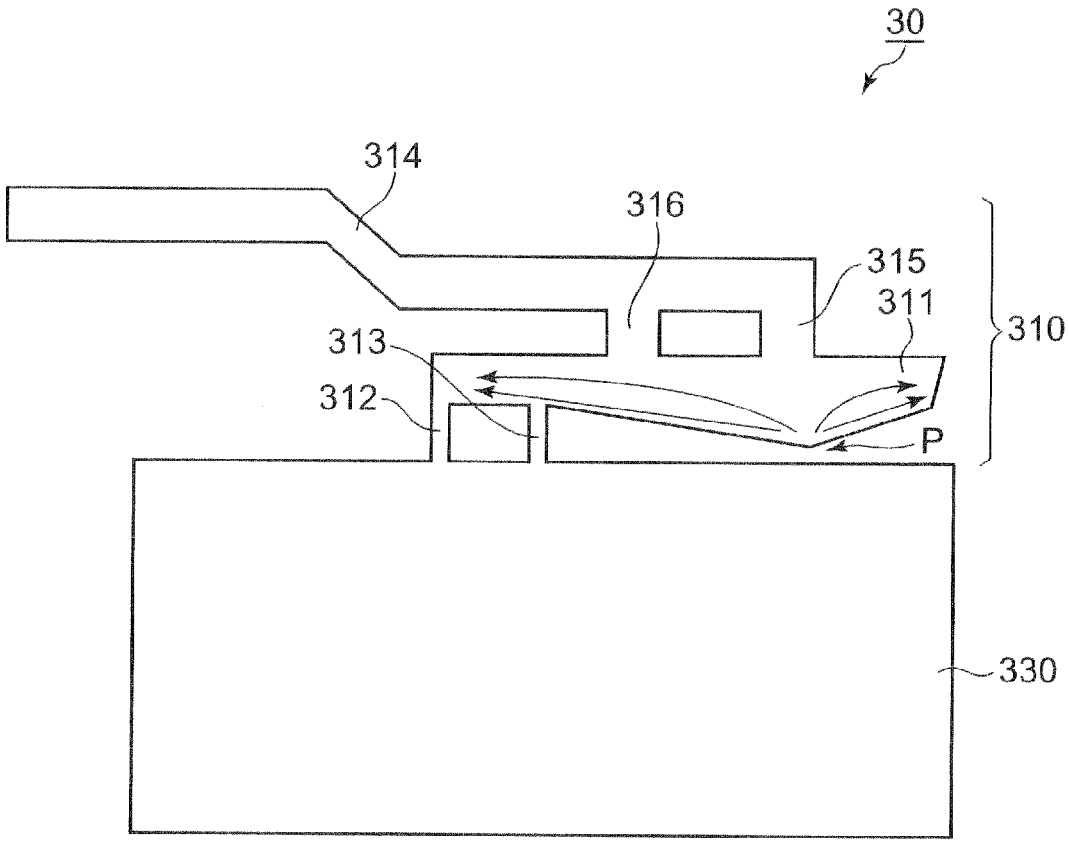
FIG. 7 shows routes of current flowing through the planar antenna of the embodiments.

FIG. 7 is a diagram showing a route for current flowing through the planar antenna 30.

As shown in FIG. 7, the planar antenna 30 has an antenna portion 310 and a ground portion 330. The ground portion 330 is a ground portion when the ground portion 320 and the chassis portion 5 are regarded as being integral with each other.

By designing the antenna element 311 in a substantially triangular shape, a plurality of length-different routes (a plurality of modes) through which current flows can be formed between the feeding point P in the neighborhood of the vertex of the triangle of the antenna element 311 and each end in the longitudinal direction of the antenna element 311 so as to be displaced inside, and thus the antenna element 311 resonates at the different modes, thereby securing the plurality of routes having different lengths through which current flows. The length of the route varies in accordance with the magnitude of the frequency. Therefore, the resonance frequency band is extended by the routes of the plurality of lengths.

Next, another configuration of broadening the resonance frequency band of the planar antenna 30 will be described.

Figure 8:
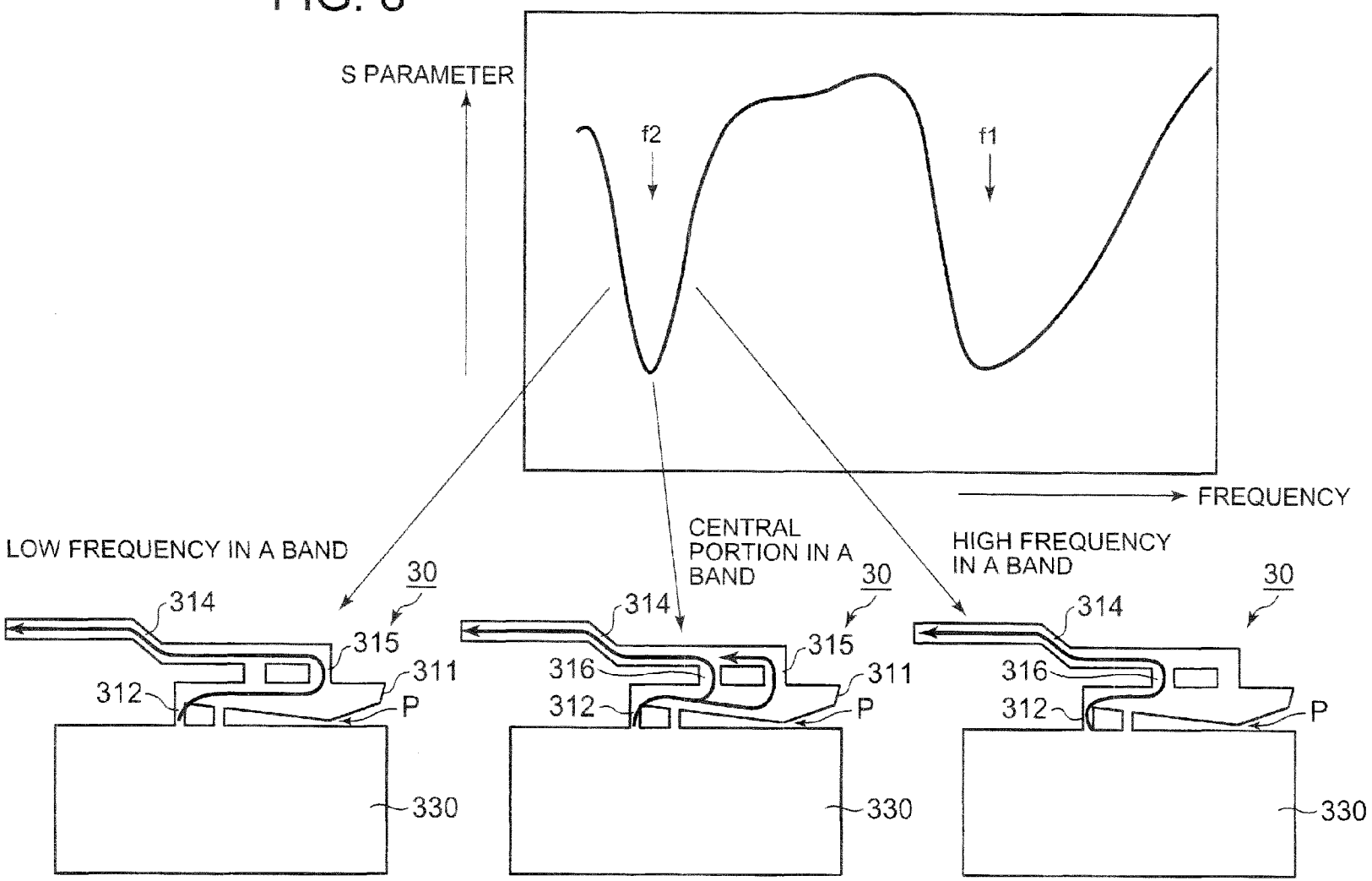
FIG. 8 shows a relationship between a frequency and an S parameter in the planar antenna of the embodiments, and routes of current under resonance around a second frequency.

FIG. 8 is a diagram showing a relationship between frequency and an S parameter in the planar antenna 30, and routes of current under resonance around a second frequency f2. The S parameter is called as a scattering matrix (S matrix) or a scattering parameter. The S parameter represents a passage/reflection power characteristic of a circuit network.

As shown in FIG. 8, the S parameter with respect to frequency is low around frequencies f1 and f2. A high gain is obtained in the band widths containing the frequencies f1 and f2 as the resonance frequencies. As shown in FIG. 8, the S-parameter low portions around the frequencies f1 and f2 are broad, and thus the band width of the resonance frequency thereof is extended.

As compared with the planar antenna 50, in the planar antenna 30, the antenna element 314 resonating at the frequency f2 is short-circuited to the antenna element 311 resonating at the frequency f1 through the short tub 315 and the short tub 316. As shown in FIG. 8, in the band of the frequency f2, when the resonating frequency is lower than the frequency f2, current flows through the route passing through the short stub 312, the antenna element 311, the short stub 315 and the antenna element 314.

When the resonating frequency is in the neighborhood of the center of the band of the frequency f2, current flows in the route passing through the short stub 312, the antenna element 311, the short stub 315 and the antenna element 314 and in the route passing through the short stub 312, the antenna element 311, the short stub 316 and the antenna element 314. When the resonance frequency is higher than the frequency f2, the current flows through the short stub 312, the antenna element 311, the short stub 316, and the antenna element 314.

Therefore, the place to which current is concentrated varies due to the provision of the short stub 316, and thus the same advantage obtained when the plurality of antenna elements different in length exist is obtained, and the band width of the resonance frequency band of the lower frequency f2 out of the two resonance frequencies f1 and f2 can be extended.

Next, the impedance matching in the planar antenna 30 will be described.

Figure 9:
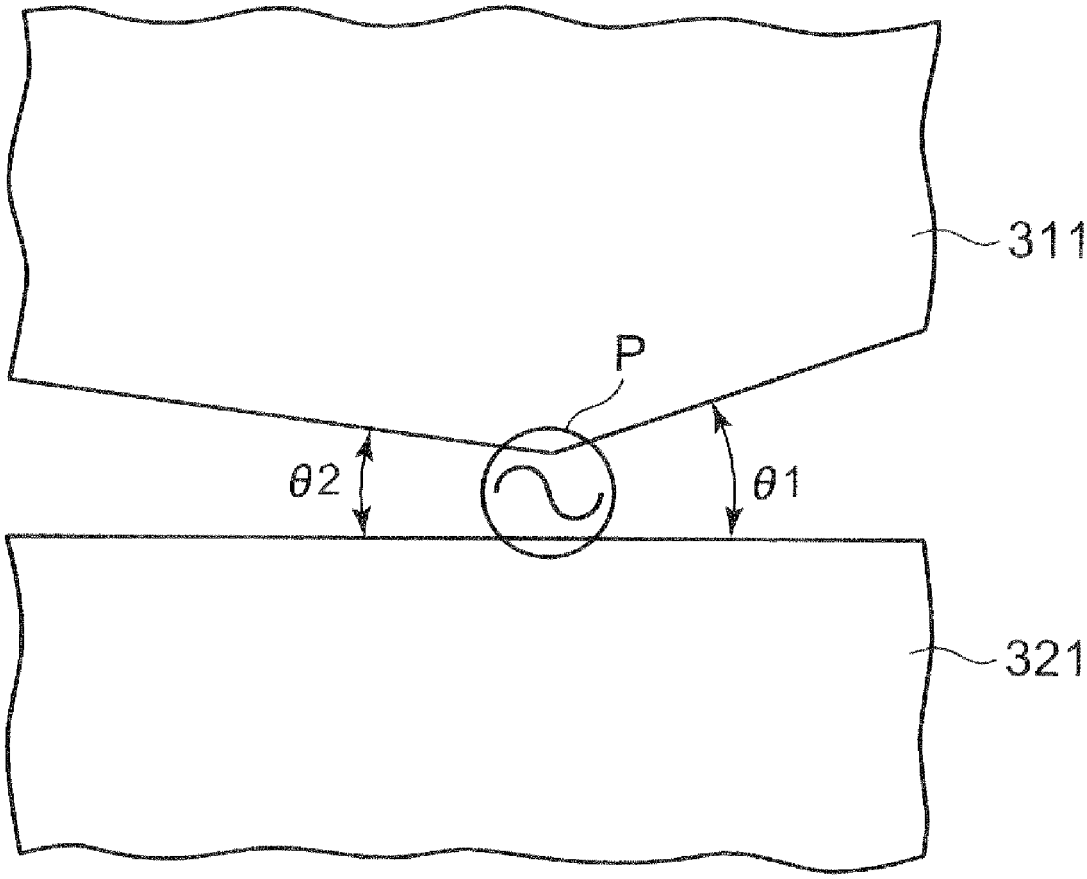
FIG. 9 shows an antenna element and a ground element around a feeding point P.

FIG. 9 is a diagram showing the antenna element 311 and the ground element 321 in the neighborhood of the feeding point P.

As shown in FIG. 9, the antenna element 311 has a substantially triangular shape having angles θ1 and θ2 with respect to the ground element 321 with the feeding point P at the center. When the angles θ1 and θ2 increase, the impedance viewed from the feeding point P increases. Furthermore, when the angles θ1 and θ2 decrease, the impedance viewed from the feeding point P is lowered. The matching of the impedance viewed from the feeding point P can be established by adjusting the angles θ1 and θ2.

Next, the shape and size of the ground portion will be described.

Figure 10A:
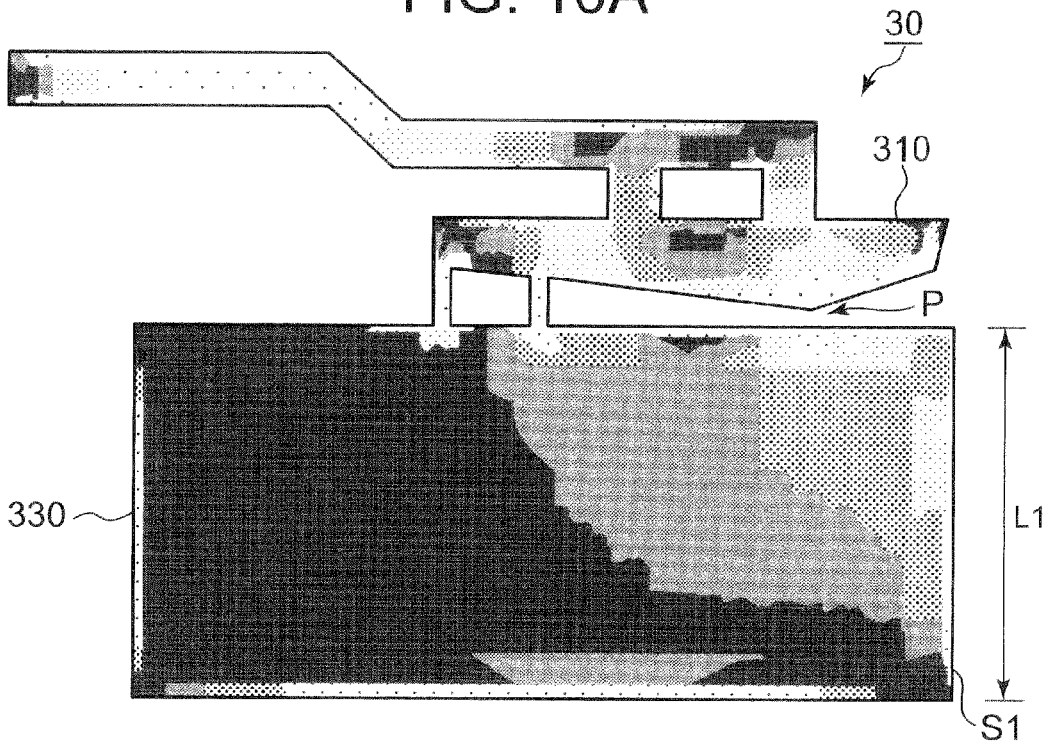
FIG. 10A shows current distribution per unit length when a radio wave having a first resonance frequency is radiated in the planar antenna of the embodiments.

FIG. 10A is a diagram showing current distribution per unit length in the planar antenna 30 when a radio wave having the resonance frequency f1 is emitted.

Figure 10B:
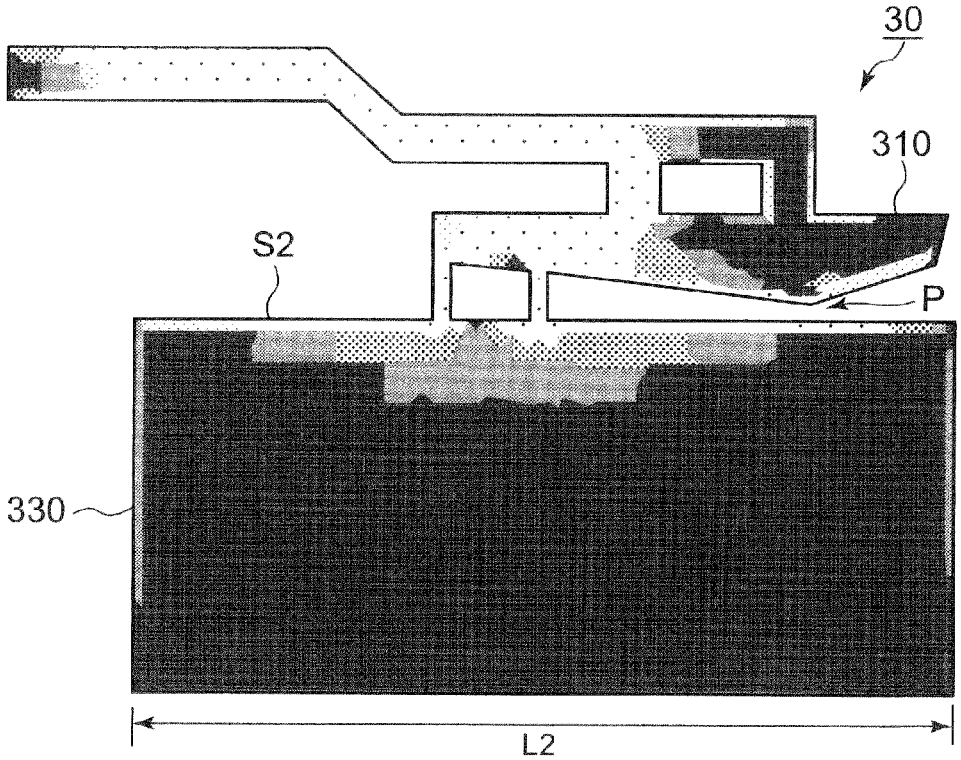
FIG. 10B shows current distribution per unit length when a radio wave having a second resonance frequency is radiated in the planar antenna.

FIG. 10B is a diagram showing current distribution per unit length in the planar antenna 30 when a radio wave having the resonance frequency f2 is emitted.

In FIGS. 10A and 10B, it is assumed that the current per unit length increases as the drawing color is shifted from black to white.

As shown in FIG. 2A and FIGS. 10A and 10B, in the planar antenna 30, the length of the side S1 in the short-side direction (horizontal direction) of the ground portion 330 is represented by L1, and the length of the side S2 in the longitudinal direction (vertical direction) is represented by L2. Here, the horizontal direction and the vertical direction are defined with respect to the ground surface when the handy terminal 1 is used. The length L1 is set to ¼ of the wavelength λ1 of the higher resonance frequency f1, and the length L2 is set to ¼ of the wavelength λ2 of the lower resonance frequency f2.

As shown in FIG. 10A, in the planar antenna 30, an area in the vicinity of the side S1 resonates and current concentrates there when the radio wave of the resonance frequency f1 is emitted, so that the emitted radio wave is a horizontally-polarized wave.

As shown in FIG. 10B, in the planar antenna 30, an area in the vicinity of the side S2 resonates and current concentrates there when the radio wave of the resonance frequency f2 is emitted, so that the emitted radio wave is a vertically-polarized wave. As described above, the polarization direction of the wave transmitted/received to/from the planar antenna 30 can be varied.

The base station receives the radio wave of the vertically-polarized wave. Electrical waves having low frequencies are little reflected, and thus it is preferable to set the radio wave of the lower frequency f2 to the vertically polarized wave in conformity with the base station. Accordingly, the length of the side S2 in the vertical direction of the ground portion 330 is set to correspond to the resonance frequency f2.

Next, the process of manufacturing the planar antenna 30 will be described.

Figure 11A:
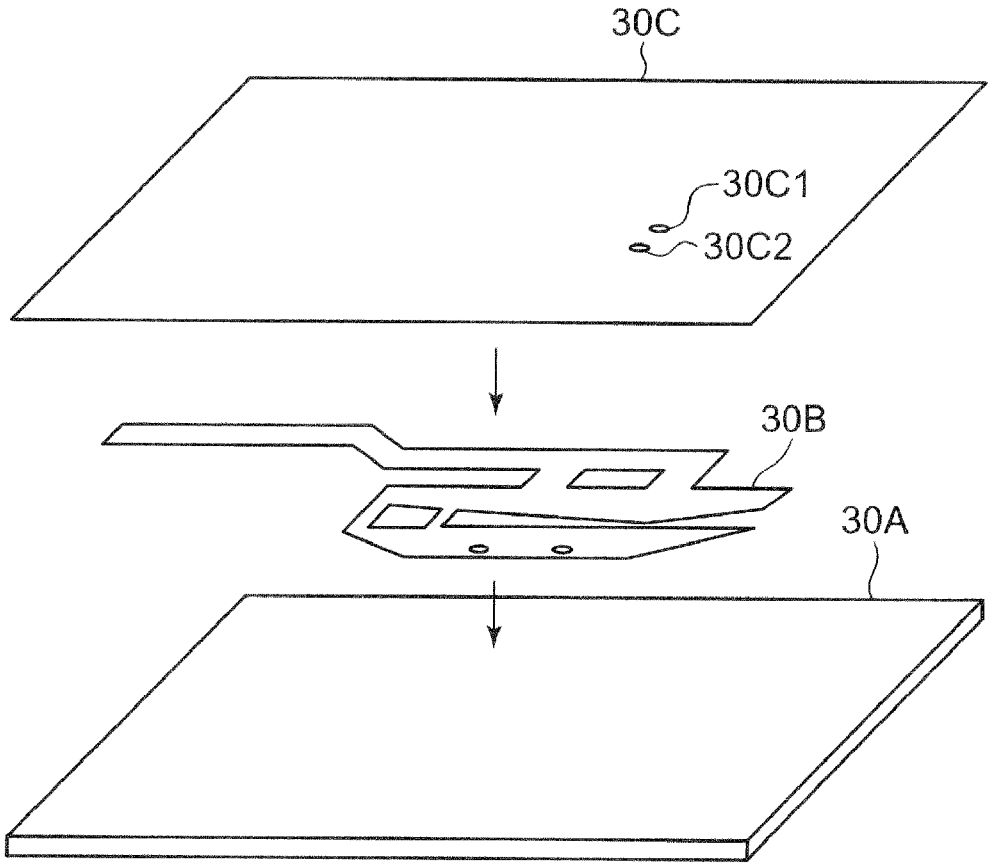
FIG. 11A is a perspective view showing a film, an antenna conductor portion and an insulating layer.
Figure 11B:
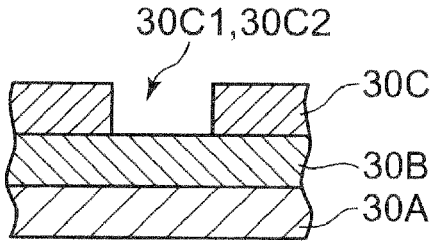
FIG. 11B is a cross-sectional view of the film, the antenna portion and the insulating layer.

FIG. 11A is a diagram showing the perspective configuration of the film 30A, the antenna conductor 30B and the insulating layer 30C, and FIG. 11B is a diagram showing the cross-sectional configuration of the film 30A, the antenna conductor 30B and the insulating layer 30C.

As shown in FIG. 11A, the antenna conductor 30B is first formed on the film 30A. The formation of the antenna conductor 30B is implemented by a method such as etching on the film 30A, adhesion of adhesive agent, double-sided adhesive tape or the like.

The insulating layer 30C is formed on the film 30A on which the antenna conductor 30B has been formed. The formation of the insulating layer 30C is implemented by adhesion of film of FPC or the like. However, the present invention is not limited to this manner, and a method of painting coating material for insulation or the like may be used. The coating material for insulation comprises a resist material such as insulating ultraviolet effect resin or the like. The insulating layer 30C is formed so that the hole portions 30C1 and 30C2 are set at the soldering position of the feed point P.

As shown in FIG. 5, the coaxial cable 40 is soldered to the hole portions 30C1 and 30C2 of the insulating layer 30C shown in FIGS. 11A and 11B. A soldering manufacturer may solder the hole portions 30C1 and 30C2 which are formed in advance, and an unskilled person can easily solder and prevent the soldering position from being displaced. Furthermore, the unnecessary film 30A and insulating layer 30C are deleted.

As described above, according to the embodiments, in the planar antenna 30, the antenna element 311 is connected to the ground portion 320 through the short stubs 312 and 313, and the feeding point P is provided between the antenna element 311 and the ground portion 320. The antenna element 311 has a triangular shape with such an angle that a distance between the antenna element 311 and the ground portion 320 increases with increasing distance from the feeding point P along the ground portion 320. The antenna element 311 has such a length that the antenna element 311 resonates at the high frequency f1. The antenna element 314 has such a length that the antenna element 314 resonates at the low resonance frequency f2. With this structure, the antenna element 311 has a plurality of antenna current routes different in length. Therefore, the band width of each of the resonance frequency f1 band and the resonance frequency f2 band can be extended. Moreover, because the planar antenna 30 (the antenna portion 310 and the ground portion 320) is planar, the storage space can be reduced. Furthermore, the handy terminal 1 having the planar antenna 30 can perform the wireless communication in which the respective band widths of the resonance frequency f1 band and the resonance frequency f2 bands are wide.

The antenna element 314 is connected to the antenna element 311 through the two short stubs 315, 316. Therefore, there exist a plurality of routes in which current flows through at least one of the short stubs 315 and 316 at a frequency in the neighborhood of the frequency f2, and thus the band width of the resonance frequency f2 band can be extended.

In the ground portion 330, the length of the side S1 is set to ¼ of the wavelength λ1 of the radio wave of the resonance frequency f1, and the length of the side S2 is set to ¼ of the wavelength λ2 of the radio wave of the resonance frequency f2. Therefore, the polarization direction of the radio wave emitted from the planar antenna 30 can be varied, and the gain can be increased. Particularly, the side S2 which is vertical when the handy terminal 1 is used is set to correspond to the lower resonance frequency f2, so that the polarization direction of the radio wave of the resonance frequency f2 having a small gain can be set to the same vertically polarized wave direction as the base station, and thus the gain can be increased.

Furthermore, the ground portion 330 comprises the ground portion 320 formed on the film 30A and the chassis portion 5. Accordingly, the chassis portion 5 can be used as the ground, and the planar antenna 30 (the antenna portion 310, the ground portion 320) and the storage space thereof can be more greatly reduced. Furthermore, the material of the ground portion 320 is reduced, and thus the cost can be reduced.

The planar antenna 30 has the insulating layer 30C. Therefore, even when the packaging density of the planar antenna 30 in the handy terminal 1 is increased, the antenna conductor portion 30B can be prevented from being short-circuited to the other parts, the cable, etc.

The insulating layer 30C has the soldering hole portions 30C1 and 30C2 for the coaxial cable 40 at the feeding point P. Therefore, the soldering position can be fixedly provided at the manufacturing stage, and variation of the antenna performance due to production tolerance can be eliminated.

(First Modification)

A first modification of the above embodiment will be described with reference to FIGS. 12A and 12B. The device configuration of this modification resides in that the planar antenna 30 in the handy terminal 1 is replaced by planar antennas 60*a* and 60*b*. The configuration of the planar antennas 60*a* and 60*b* will be mainly described, and the description of the other configuration is omitted.

Figure 12A:
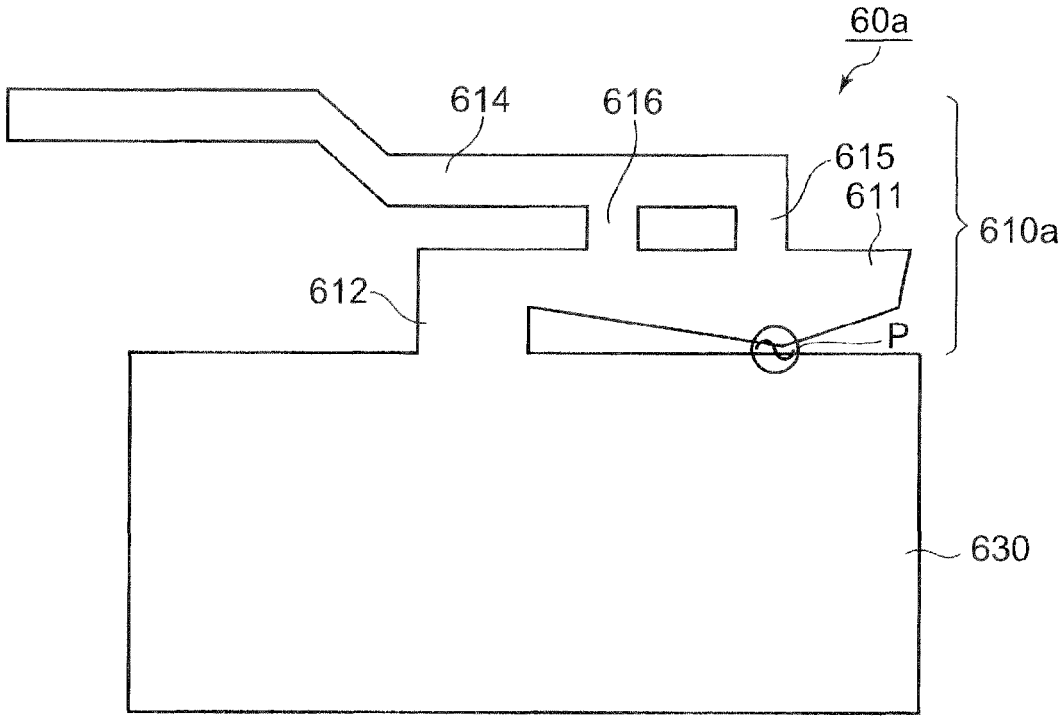
FIG. 12A shows a configuration of a planar antenna according to a first modification.

FIG. 12A is a diagram showing the configuration of the planar antenna 60*a*. As shown in FIG. 12A, the planar antenna 60*a* comprises an antenna portion 610*a* and a ground portion 630 as an antenna conductor portion. The antenna portion 610*a* has an antenna element 611 as a first antenna element, a short stub 612 as a first short stub, an antenna element 614 as a second antenna element and short stubs 615 and 616 as second short stubs. However, the ground portion 630 contains the ground portion of the antenna conductor portion and the chassis portion 5. The antenna element 611, the antenna element 614, the short subs 615 and 616 and the ground portion 630 are the same as the antenna element 311, the antenna element 314, the short stubs 315, 316 and the ground portion 330 of the planar antenna 30 in this order.

In the planar antenna 60*a*, a feeding point P is provided between the antenna element 611 and the ground portion 630. Furthermore, the planar antenna 60*a* has a film and an insulating layer (not shown) as in the case of the film 30A and the insulating layer 30C of the planar antenna 30.

The planar antenna 60*a* is provided with a single short stub 612 instead of the two short stubs 312 and 313, and one end of the antenna element 611 is short-circuited to the ground portion 630 through the short stub 612. The short stub 612 has such a shape and width that the empty area between the short stubs 312 and 313 is filled.

According to the planar antenna 60*a* of this modification, the same advantage as the planar antenna 30 can be obtained. This is because the current flowing in the short stub 612 concentrates on both the right and left end portions thereof and thus the short stub 612 has the same function as the short stubs 312 and 313. Furthermore, three or more short stubs may be provided to connect the antenna element 611 and the ground portion 630.

Figure 12B:
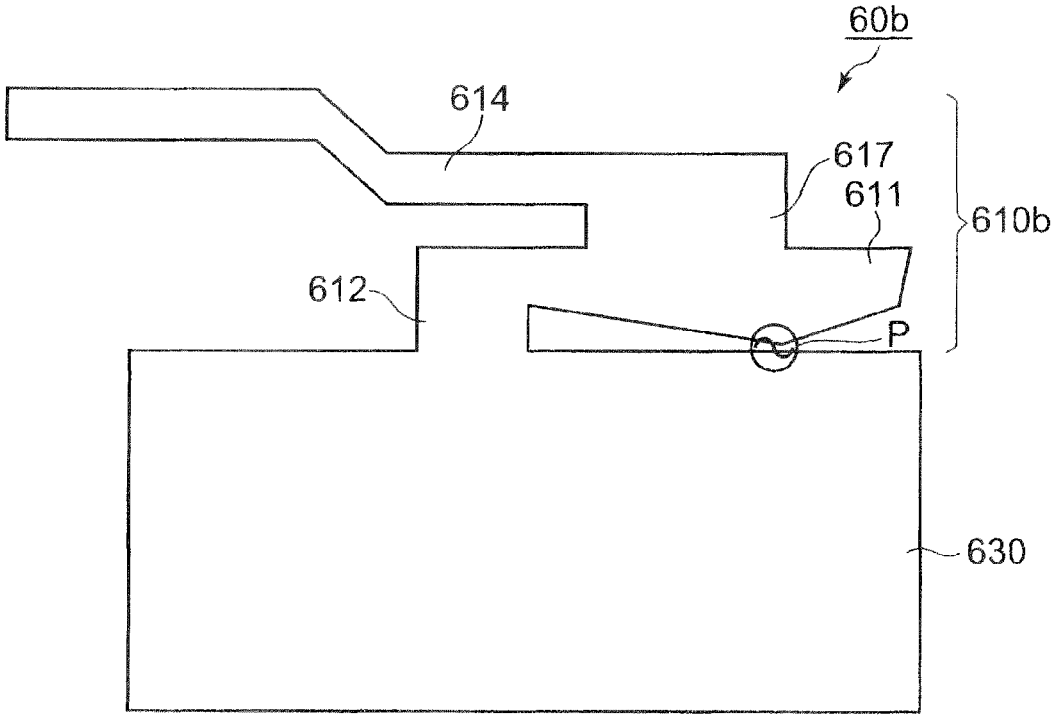
FIG. 12B shows a configuration of another planar antenna according to the first modification.

FIG. 12B is a diagram showing the configuration of a planar antenna 60*b*. As shown in FIG. 12B, the planar antenna 60*b* comprises an antenna portion 610*b* and a ground portion 630 as an antenna conductor. The antenna portion 610*b* has an antenna element 611, a short stub 612, an antenna element 614 and a short stub 617 as a second short stub. The planar antenna 60*b* has a film and an insulating layer (not shown) as in the case of the film 30A and the insulating layer 30C of the planar antenna 30.

The planar antenna 60*b* is provided with a single short stub 617 instead of the two short stubs 615 and 616, and one end of the antenna element 614 is short-circuited to the antenna element 611 through the short stub 617. The short stub 617 has such a shape and width that the empty area between the short stubs 615 and 616 is filled.

According to the planar antenna 60*b* of this modification, the same advantage as the planar antenna 30 is obtained. This is because current flowing in the short stub 617 concentrates on both the right and left end portions and thus the short stub 617 has the same function as the short stubs 615 and 616. Three or more short stubs may be provided to connect the antenna element 611 and the antenna element 614.

(Second Modification)

A second modification of the above embodiment will be described with reference to FIG. 13. The device configuration of this modification resides in that the planar antenna 30 in the handy terminal 1 is replaced by a planar antenna 70. The configuration of the planar antenna 70 will be mainly described, and the description of the other configuration is omitted.

Figure 13:
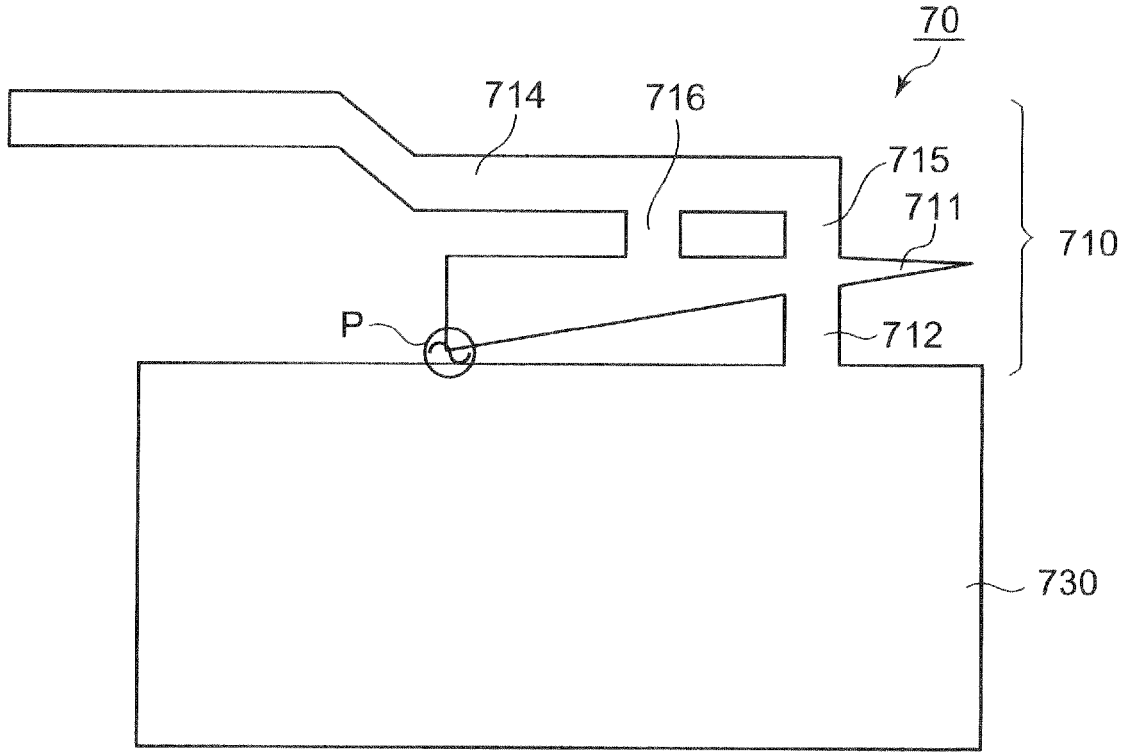
FIG. 13 shows a configuration of a planar antenna according to a second modification.

FIG. 13 is a diagram showing the configuration of the planar antenna 70. As shown in FIG. 13, the planar antenna 70 has an antenna portion 710 and a ground portion 730 as an antenna conductor portion. The antenna portion 710 has an antenna element 711 as a first antenna element, a short stub 712 as a first short stub, an antenna element 714 as a second antenna element, and short stubs 715 and 716 as second short stubs. The ground portion 730 contains the ground portion of the antenna conductor portion and the chassis portion 5. The antenna element 714, the short stubs 715 and 716 and the ground portion 730 are the same as the antenna element 314, the short stubs 315 and 316 and the ground portion 330 of the planar antenna 30 in this order. The planar antenna 70 has a film and an insulating layer (not shown) as in the case of the film 30A and the insulating layer 30C of the planar antenna 30.

The antenna element 711 has a right triangular shape, and a feeding point P is provided between a vertex portion at the lower side of FIG. 13 and the ground portion 730. That is, the antenna element 711 has a shape with such an angle that a distance between the antenna element 711 and the ground portion 730 increases with increasing distance from the feeding point P along the upper side of the ground portion 730.

The short stub 712 is located below the short stub 715. The antenna element 711 is short-circuited to the ground portion 730 through the short stub 712. The antenna element 711, the ground portion 730 and the short stub 712 constitutes a loop.

According to the planar antenna 70 of this modification, the same advantage as the planar antenna 30 can be obtained. Furthermore, the position of the feeding point P provided between the antenna element and the ground portion may be changed to another position in the loop constructed by the short stub. The antenna element corresponding to the resonance frequency f1 may have a shape with such an angle that a distance between the antenna element and the ground portion increases with increasing distance from the feeding point P along the upper side of the ground portion.

(Third Modification)

A third modification of the above embodiment will be described. The device configuration of this modification resides in that the planar antenna 30 in the handy terminal 1 is replaced by a planar antenna 80. The configuration of the planar antenna 80 will be mainly described, and the description of the other configuration is omitted.

Figure 14:
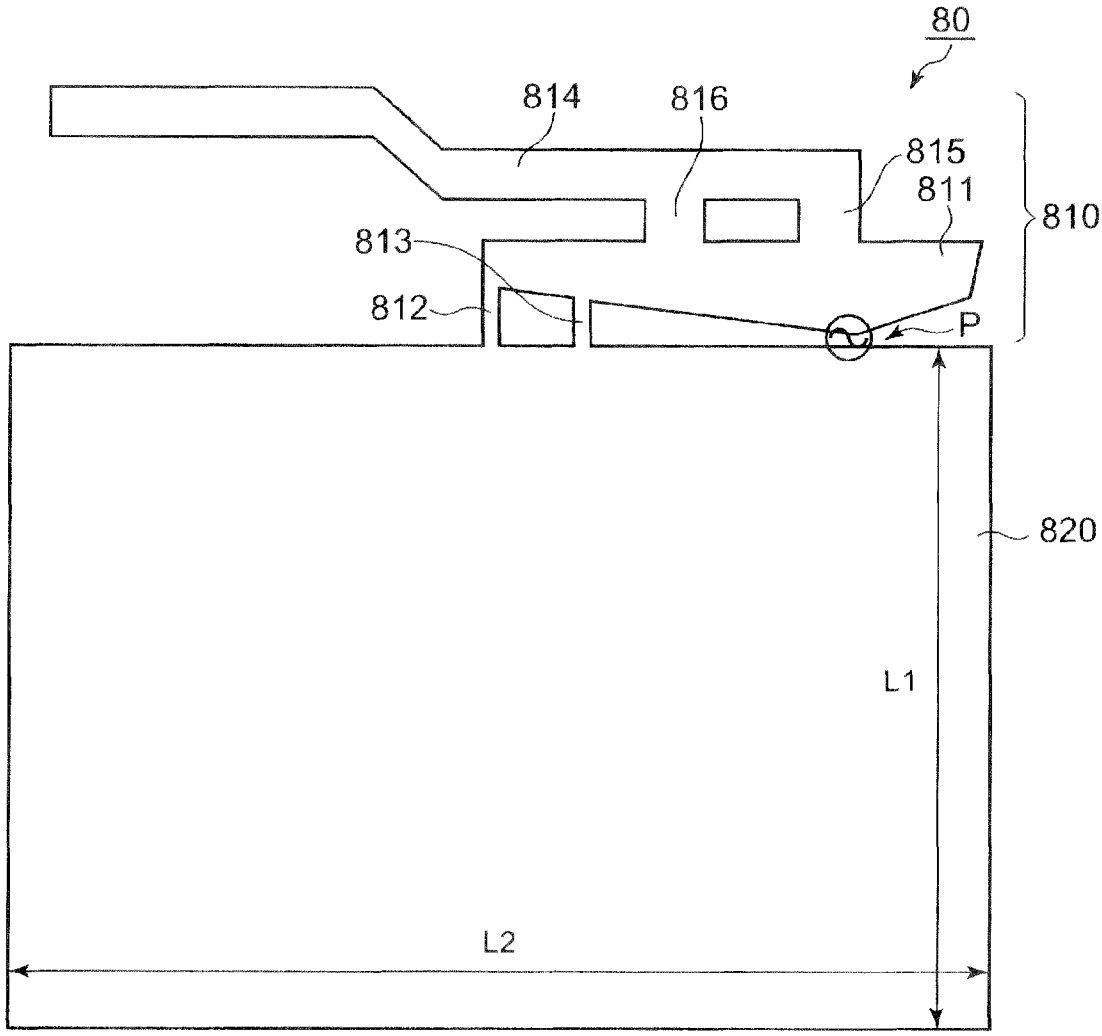
FIG. 14 shows a configuration of a planar antenna according to a third modification.

FIG. 14 is a diagram showing the configuration of the planar antenna 80. As shown in FIG. 14, the planar antenna 80 comprises, as an antenna conductor portion, an antenna portion 810 and a ground portion 820 as a first conductor. The antenna portion 810 has an antenna element 811 as a first antenna element, short stubs 812 and 813 as first short tubs, an antenna element 814 as a second antenna element and short stubs 815 and 816 as second short stubs. The antenna element 811, the short stubs 812 and 813, the antenna element 814, the short stubs 815 and 816 and the ground portion are the same as the antenna element 311, the short stubs 312 and 313, the antenna element 314 and the short stubs 315 and 316 in this order.

In the planar antenna 30, the ground portion 320 which is the conductor sandwiched between the film 30A and the insulating layer 30C is provided integrally with the chassis portion 5 and considered as the ground portion 330. The planar antenna 80 has a ground portion 820 which is a conductor sandwiched between the film and the insulating layer. In the antenna portion 810, a feeding point P is provided between the antenna element 811 and the ground portion 820. The ground portion 820 is not directly electrically connected to the chassis portion 5.

As in the case of the ground portion 330, the ground portion 820 is rectangular, and the length in the short-side direction thereof is represented by L1 while the length in the longitudinal direction thereof is represented by L2. The length L1 is set to the length of ¼ of the wavelength λ1 of the higher resonance frequency f1, and the length L2 is set to the length of ¼ of the wavelength λ2 of the lower resonance frequency.

According to the planar antenna 80 of this modification, the same advantage as the planar antenna 30 can be obtained, and also the ground portion 820 of the planar antenna 80 can be manufactured integrally with the film, the conductor and the insulator.

The embodiment and the modifications described above are examples of the planar antenna and the electronic device, and the present invention is not limited to these embodiment and modifications.

In the above embodiment and the above modifications, the handy terminal is used as the electronic device. However, the present invention may be applied to PDA (Personal Digital Assistant), a cellular phone, a portable communication terminal, a portable device having a wireless communication function such as a portable type computer or the like, and other electronic devices.

In the above embodiment, the antenna element 311 may be oblong or the like, and a plurality of short stubs may be provided to connect the antenna element 311 and the antenna element 314. The ground portion may be constructed by only a ground part which is not the antenna conductor portion such as the chassis portion 5 or the like. Furthermore, at least two of the above embodiment and the modifications may be properly combined with each other.

Furthermore, in the above embodiment and the modifications, the ground portion is rectangular, and the length L1 in the horizontal direction corresponds to the higher resonance frequency f1 while the length L2 in the vertical direction corresponds to the lower resonance frequency f2. However, the present invention is not limited to this style. For example, the length L1 in the horizontal direction may correspond to the resonance frequency f2 while the length L2 in the vertical direction corresponds to the resonance frequency f1.

In the above embodiment and the modifications, the planar antenna is the multiband antenna resonating at the two frequency bands, however, the present invention is not limited to this style. For example, the number of the antenna elements of the planar antenna may be set to three or more so that a multiband antenna resonating at three or more frequency bands corresponding to the lengths of the respective antenna elements is constructed.

Here, an example of the planar antenna having the three resonance frequency bands will be described.

Figure 15:
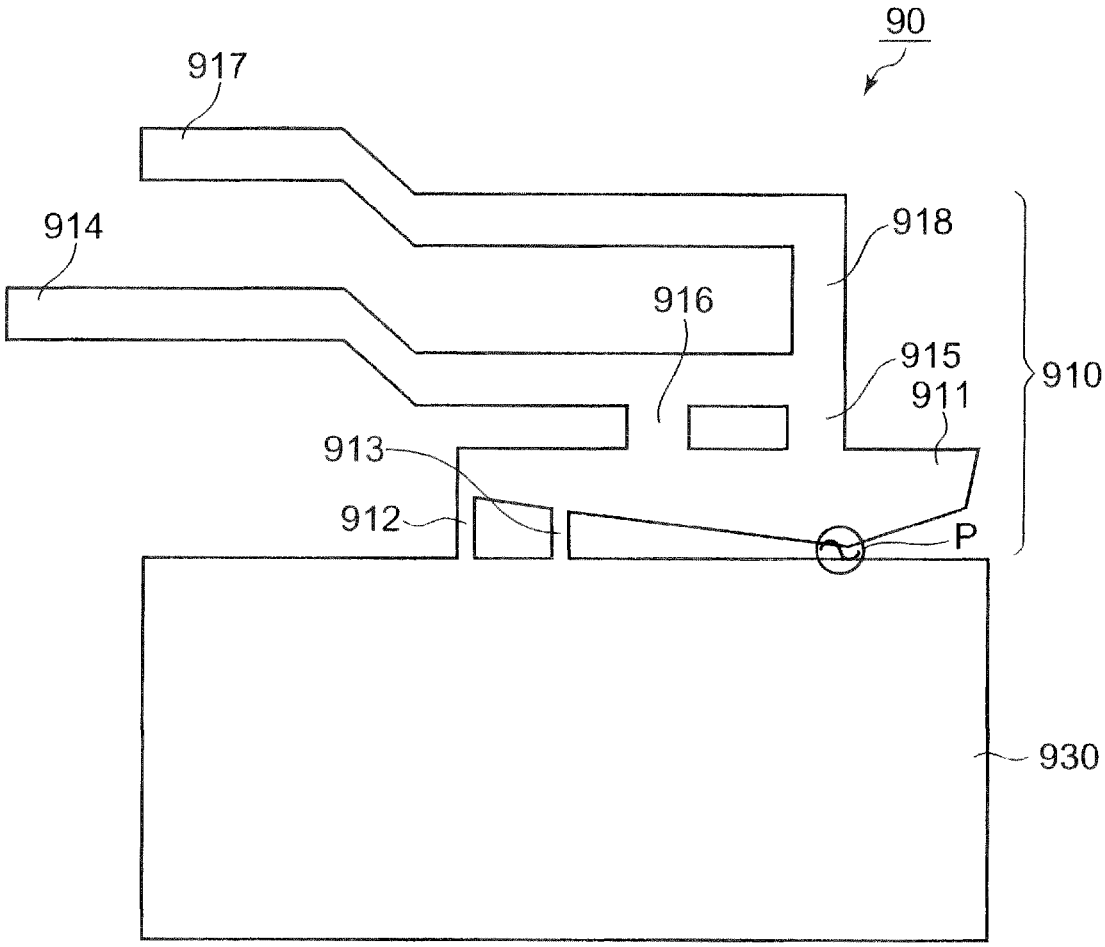
FIG. 15 shows a configuration of a planar antenna having three resonance frequencies.

FIG. 15 is a diagram showing the configuration of the planar antenna 90 having the three resonance frequency bands.

As shown in FIG. 15, the planar antenna 90 has an antenna portion 910 and a ground portion 930 as an antenna conductor portion. The antenna portion 910 has an antenna element 911 as a first antenna element, short stubs 912 and 913 as first short stubs, an antenna element 914 as a second antenna element, short stubs 915 and 916 as second short stubs, an antenna element 917 and a short stub 918. The ground portion 930 contains the ground portion of the antenna conductor portion and the chassis portion 5. The antenna element 911, the short stubs 912 and 913, the antenna element 914, the short stubs 915 and 916 and the ground portion 930 are the same as the antenna element 311, the short stubs 312 and 313, the antenna element 314, the short stubs 315 and 316 and the ground portion 330 of the planar antenna 30 in this order.

The antenna element 917 is connected to the antenna element 914 through the short stub 918. An end portion of the antenna element 914 (the connection side to the short stub 915) and an end portion of the antenna element 917 are connected to each other through the short stub 918. The antenna element 911 has a length at which it resonates at a frequency f1. The antenna element 914 has a length at which it resonates at a frequency f2 lower than the frequency f1. The antenna element 917 has a length at which it resonates at a frequency f3 between the frequency f1 and the frequency f2. However, the resonance frequency is not limited to the relationship of $f2<f3<f1$, and it may satisfy the relationship of $f3<f2<f1$, for example.

If the number of the resonance frequencies is equal to three or more, the shape of the ground portion may be a shape having three or more sides different in length from one another, such as a trapezoid, and each side may have the length corresponding to each resonance frequency (the length of ¼ of the wavelength of the radio wave of the resonance frequency).

In the above embodiments and the above modifications, the insulating layer of the planar antenna is located at the case 2 side. However, the present invention is not limited to this style. The film of the planar antenna may be located at the case 2 side.

In the planar antennas of the above embodiment and the above modifications, the hole portion penetrating through the film and the insulating layer may be provided at a portion in which no antenna conductor portion exists. For example, another insulating part, for example, an insulating support part for the case 2 or the like may be made to penetrate through the hole portion.

With respect to the detailed configurations and operations of the respective elements of the planar antennas and the handy terminals as electronic devices in the above-described embodiments, it will be apparent to those skilled in the art that various modification and variations can be made without departing from the scope of the invention.

The entire disclosure of Japanese Patent Application No. 2008-140595 filed on May 29, 2008 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A planar antenna, comprising:

a film formed of a planar insulating material;

an antenna portion which is a planar conductor on the film; and a ground portion which is a conductor to be grounded, wherein the antenna portion comprises:

a plurality of first short stubs;

a first antenna element which is connected to the ground portion through the plurality of first short stubs and whose shape has an angle such that a distance between the first antenna element and the ground portion increases with increasing distance from a feeding point along the ground portion, the feeding point being provided between the first antenna element and the ground portion;

a plurality of second short stubs; and a second antenna element which is connected to the first antenna element through the plurality of second short stubs.

2. The planar antenna according to claim 1, wherein the ground portion has a plurality of sides whose respective lengths are ¼ of wavelengths of resonance frequencies, the resonance frequencies being different from one another.

3. The planar antenna according to claim 1, wherein the ground portion comprises at least one of a first conductor portion and a second conductor portion, the first conductor portion being planar and formed on the film, and the second conductor portion not being formed on the film.

4. The planar antenna according to claim 1, further comprising an insulating layer formed on the antenna portion and the ground portion.

5. The planar antenna according to claim 4, wherein the insulating layer includes a hole portion at a position of soldering a feeding cable at the feeding point.

6. A planar antenna, comprising:

a film formed of a planar insulating material;

an antenna portion which is a planar conductor on the film; and a ground portion which is a conductor to be grounded, wherein the antenna portion comprises:

a plurality of first short stubs;

a first antenna element which is connected to the ground portion through the plurality of first short stubs, a feeding point being provided between the first antenna element and the ground portion;

a plurality of second short stubs; and a second antenna element which is connected to the first antenna element through the plurality of second short stubs.

7. The planar antenna according to claim 6, wherein the ground portion has a plurality of sides whose respective lengths are ¼ of wavelengths of resonance frequencies, the resonance frequencies being different from one another.

8. The planar antenna according to claim 6, wherein the ground portion comprises at least one of a first conductor portion and a second conductor portion, the first conductor portion being planar and formed on the film, and the second conductor portion not being formed on the film.

9. The planar antenna according to claim 6, further comprising an insulating layer formed on the antenna portion and the ground portion.

10. The planar antenna according to claim 9, wherein the insulating layer includes a hole portion at a position of soldering a feeding cable at the feeding point.

11. An electronic device, comprising:

the planar antenna according to claim 1;

a communication unit to communicate with an external device through the planar antenna; and a control unit to control the communication unit.

12. An electronic device, comprising:

the planar antenna according to claim 6;

a communication unit to communicate with an external device through the planar antenna; and a control unit to control the communication unit.

* * * * *